US005662288A

United States Patent [19]

Chiang

[11] Patent Number: 5,662,288

[45] Date of Patent: Sep. 2, 1997

[54] WIDTH CHANGEABLE PAPER TOWEL HOLDER

[75] Inventor: Mei-Ling Chiang, Taipei, Taiwan

[73] Assignee: Taiwan Scott Paper Corporation, Taipei, Taiwan

[21] Appl. No.: 498,760

[22] Filed: Jul. 6, 1995

[51] Int. Cl.[6] ..... B65H 49/00

[52] U.S. Cl. ..... 242/596.8; 242/596; 242/596.1

[58] Field of Search ..... 242/596, 596.1, 242/596.7, 596.8

[56] References Cited

U.S. PATENT DOCUMENTS

| | | | |
|---|---|---|---|
| 1,811,779 | 6/1931 | Caps | 242/596.1 |
| 2,144,757 | 1/1939 | Gilling et al. | 242/596.8 |
| 2,222,951 | 11/1940 | Krueger | 242/596.8 |
| 3,088,686 | 5/1963 | Cury | 242/596.1 |
| 4,097,002 | 6/1978 | Krueger | 242/596.8 |
| 4,915,316 | 4/1990 | Bastian | 242/596.8 |

FOREIGN PATENT DOCUMENTS

| | | | |
|---|---|---|---|
| 1301030 | 8/1969 | Germany | 242/596.1 |

*Primary Examiner*—William E. Terrell

*Assistant Examiner*—Khoi H. Tran

*Attorney, Agent, or Firm*—Merchant, Gould, Smith, Edell, Welter & Schmidt, P.A.

[57] ABSTRACT

The present invention relates to a width changeable paper towel holder designed for presently available paper towels of different specifications. The towel holder has a fixed plate, a pair of pull-out plates and a pair of arm plates wherein the fixed plate is secured to a wall surface or any other fixed object, the pair of the pull-out plates, each on either side, being slidably received between an upper and a lower grooved rails provided on the fixed plate. An arm plate pivoted to the end of each of the pull-out plates can be resiliently retained in a locating hole on one or the other end of an elongate slot by means of a locating button such that the pull-out plates can be positioned when being pulled out or pushed in, thereby to provide two different widths between the arm plates for loading paper towels of different specifications.

2 Claims, 7 Drawing Sheets

WIDTH CHANGEABLE PAPER TOWEL HOLDER

The present invention relates to a width changeable paper towel holder designed for presently available paper towels of different specifications which can be adapted for holding a web of particular paper towels by pulling to position.

Paper towels have become a necessity in kitchens and bathrooms in today's homes and they are typically dispensed from a web which is suspended at both ends on shaft tubes in a holder. As shown in FIG. 1, a conventional paper towel holder is illustrated as having a generally "⊓" shaped configuration with a flat intermediate section A for adhering or fastening to a fixed object (such as a wall surface), the supporting arms B on both ends being each provided at the end with opposed retainers C. Said retainers C serve to retain the end openings of the paper towel web D such that the paper towel can be pulled to rotate. However, paper towels now available in the market come indifferent widths. As a result, the above mentioned fixed holders do not meet the needs for paper towels in different specifications. Therefore, if paper towels of a different specification have been inadvertently purchased, they may-not fit into an existing holder.

Accordingly, the paper towel holder of the present invention intended for use with paper towels of two standard widths is designed to accommodate paper towels of either of the two standard widths for easy and convenient dispensing.

The primary object of the present invention is to provide a paper towel holder capable of being changed between two different widths by means of a mechanism which can be pulled and resiliently retained for holding paper towels of different specifications so as to avoid the inconveniences due to buying paper towels of the wrong size.

These and other objects, features and functions of the present invention will become apparent from the following description of a preferred embodiment thereof in conjunction with the accompanying drawings in which.

Figure 1:
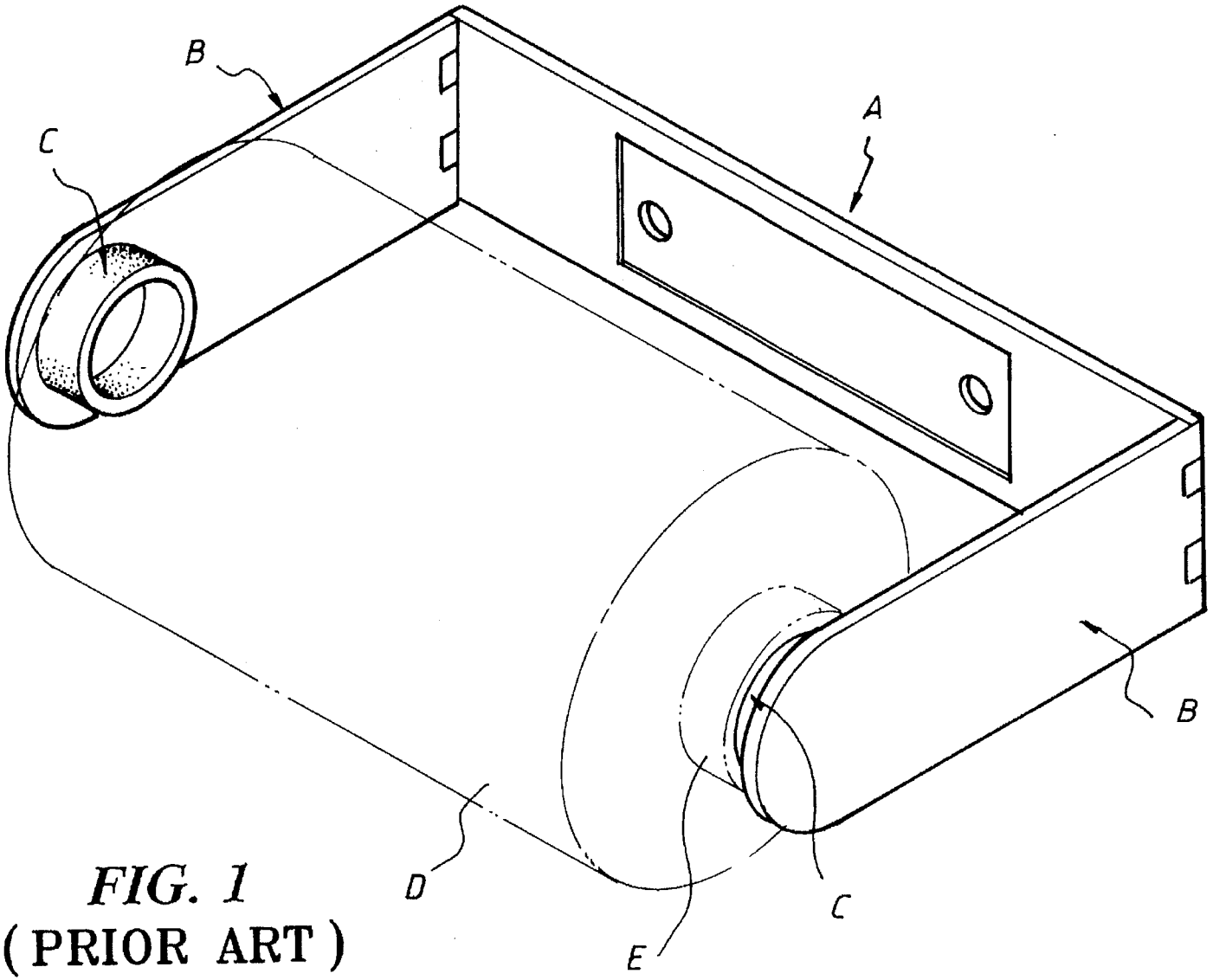
FIG. 1 (PRIOR ART)
FIG. 1 is a perspective view of a conventional paper towel holder.
Figure 2:
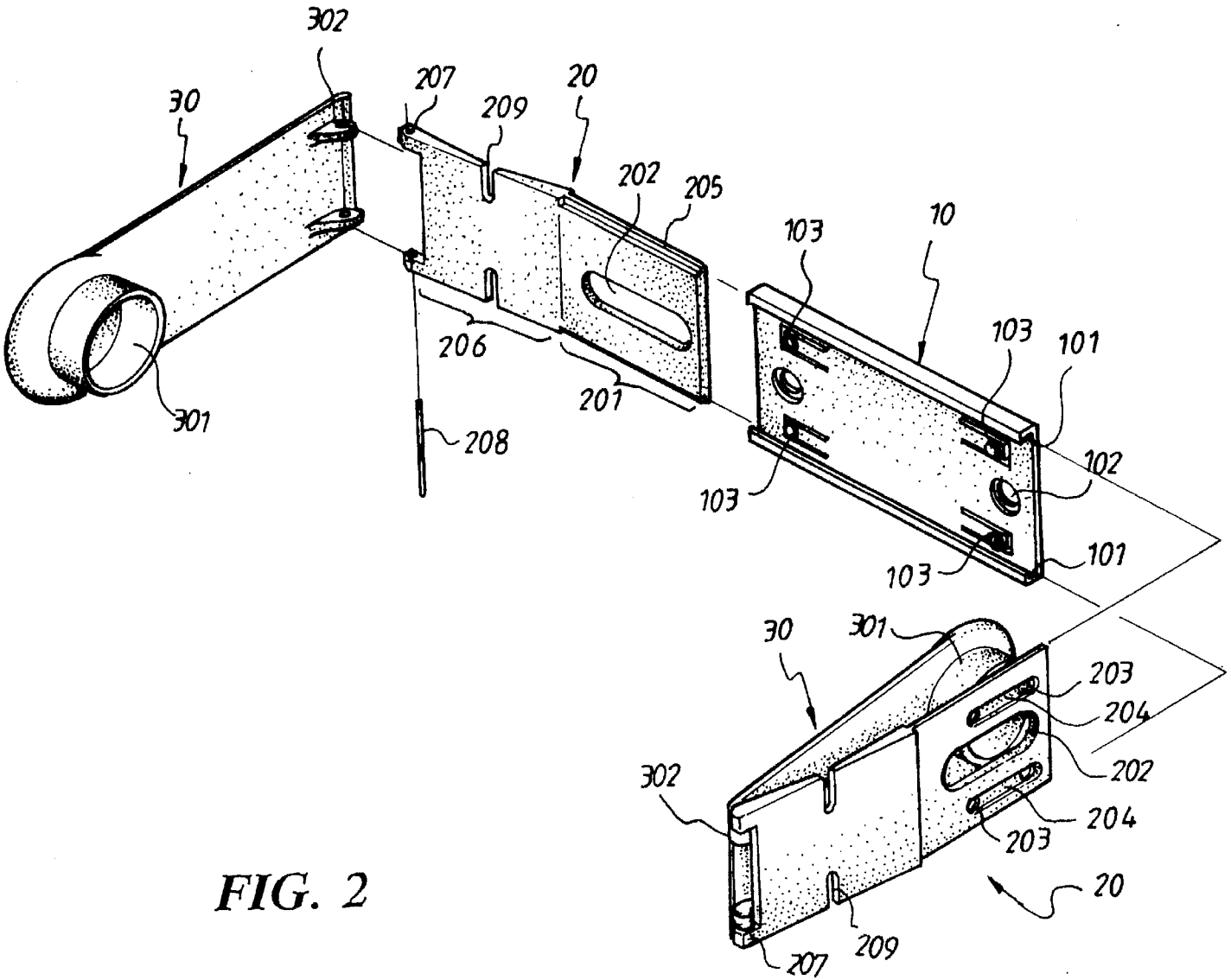
FIG. 2 is an exploded view of a paper towel holder of the present invention.

Referring to FIG. 2, the paper towel holder 1 of the present invention comprises a fixed plate 10, a pair of pull-out plates 20 and a pair of supporting arm plates 30. The fixed plate is an elongated plate body, the upper and lower sides thereof being each provided with an opposed grooved rail 101. The elongated plate body is provided on either side with a nail hole 102, and on the four corners of both sides with four resilient buttons 103. The pull-out plates 20 and the supporting arm plates 30 are pivotally assembled. The pull-out plates 20 each include a flat inner plate 201 and a resilient outer plate 206. The inner plate 201 has stepped flanges 205 on the end faces of the upper and lower edges and be provided in the center with a transverse slot 202, a recessed slot 204 being provided above and below the slot 202 on the back side of the inner plate 201. The slot 204 is provided on both ends with further recessed retaining holes 203 and the outer plate 206 is provided on the ends with a pair of lugs 207 for a stud shaft 208 to pass therethrough to be secured to the supporting arm plates 30. In addition, the outer plate 206 can be provided with a longitudinal open notch 209 such that the outer plate 206 may have suitable resiliency. The supporting arm plates 30 are each provided at one end with a pivotal portion 302 for pivotal connection to the lug 207 and the stud shaft 208. A fitting tube 301 is projected from the inner side of the other end of each of the supporting arm plates 30 into which the shaft tube of the paper towel web is inserted.

Figure 3:
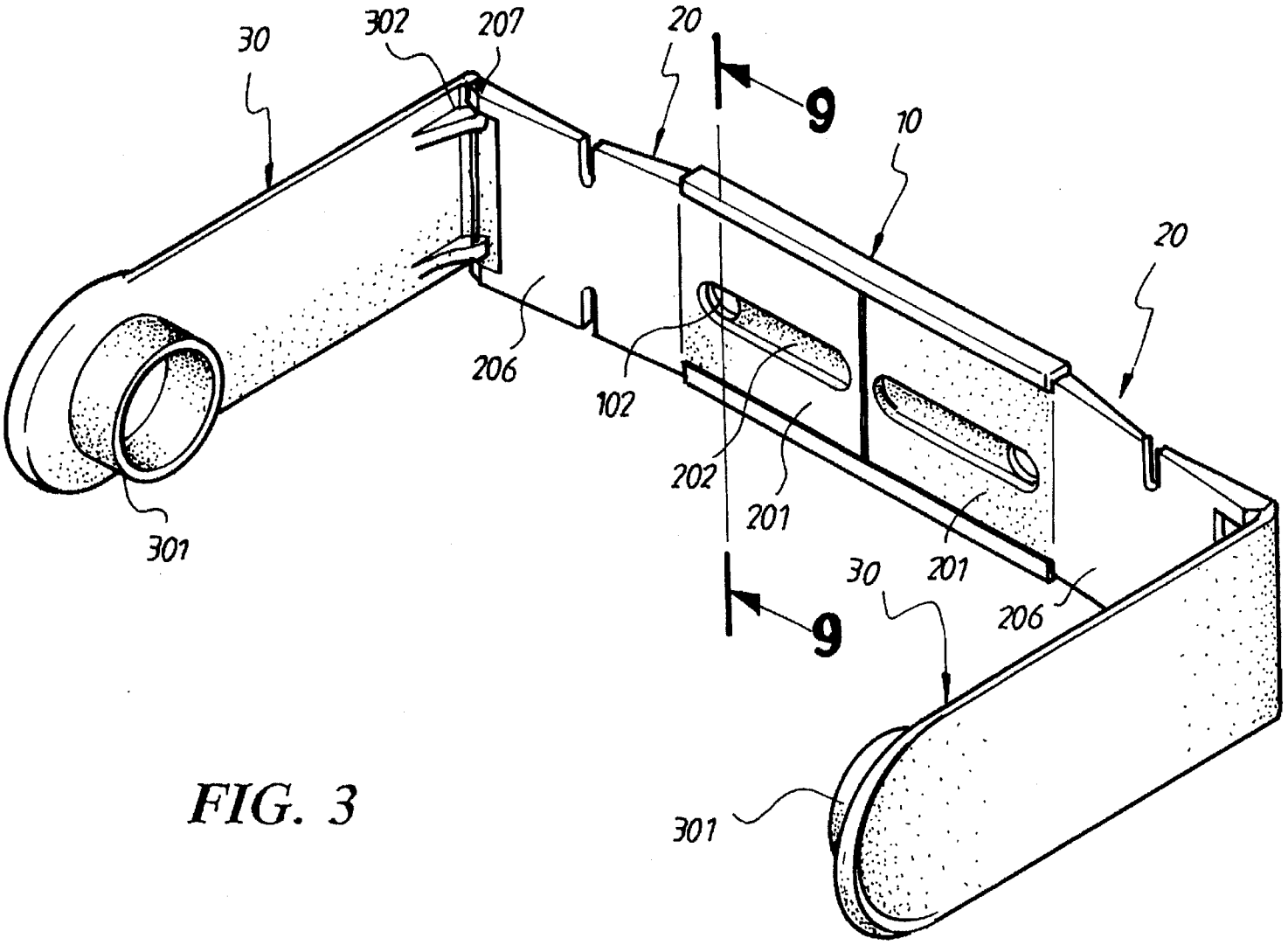
FIG. 3 is a perpective view of the paper towel holder of the present invention for use with paper towels of a small size.
Figure 4:
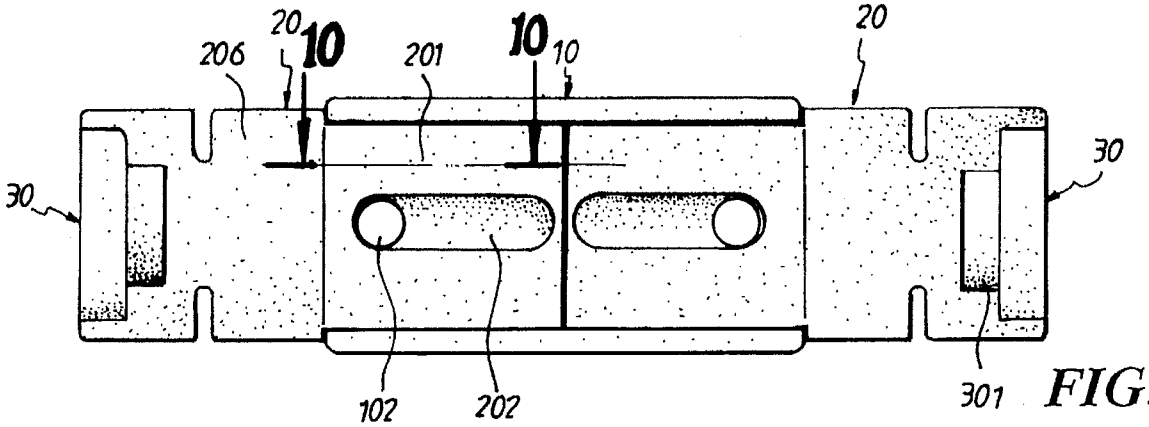
FIG. 4 is a front elevation view of the paper towel holder of FIG. 3.
Figure 5:
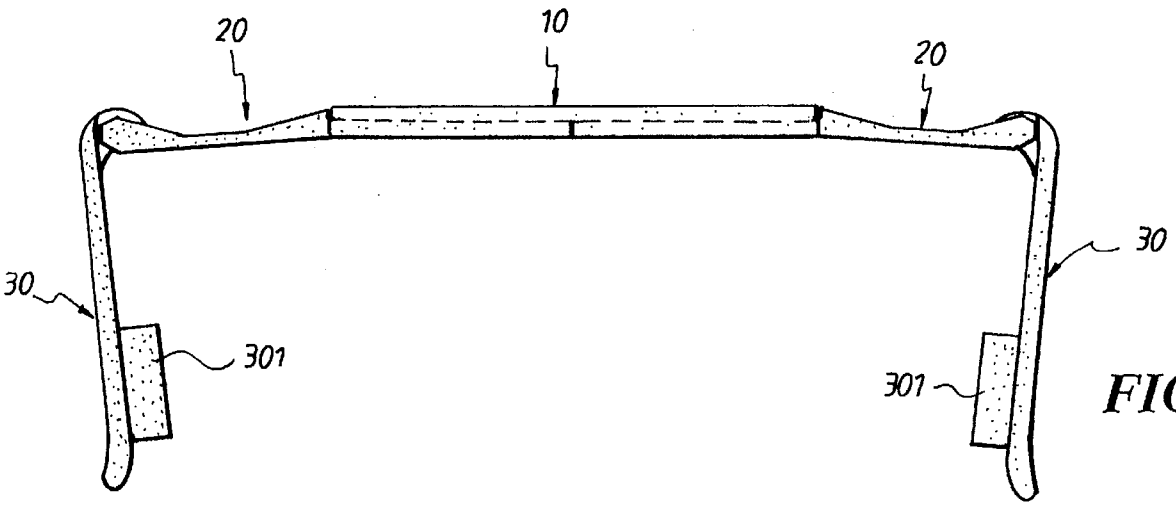
FIG. 5 is a top view of the paper towel holder of FIG. 3.

FIGS. 3, 4 and 5 are perspective, front elevation and top views, respectively, of the holder 1 of the present invention. It can be seen that the pull-out plates 20 are moved closer to the fixed plate 10 such that the distance between the fitting tubes 301 of the supporting arm plates 30 is reduced for accommodating paper towels of the small size.

As shown in FIG. 3, the slots 202 are provided for avoiding interference with the nail heads projected from the nail holes 102 such that the pull-out plates 20 can slide smoothly to and from the fixed plate 10. It can be seen from the cross section view of FIG. 9 taken along line 9—9 that the flanges 205 of the inner plates 201 of the pull-out plates 20 can be retained in the upper and lower grooved rails 101 on the fixed plate 10 with the resilient buttons 103 being retained and secured in the retaining holes 203. From the cross section view of FIG. 10 taken along line 10—10 in FIG. 4, it can be seen that the inner plates 201 of the pull-out plates 20 slide into the fixed plate 10 and the inner plates 201 are in a first retained position, the resilient buttons 103 being retained in the retaining holes 203 on the outer ends of the slots 204 such that the width between the fitting tubes of the supporting arm plates 30 is adapted for accommodating paper towels of the small size.

Figure 6:
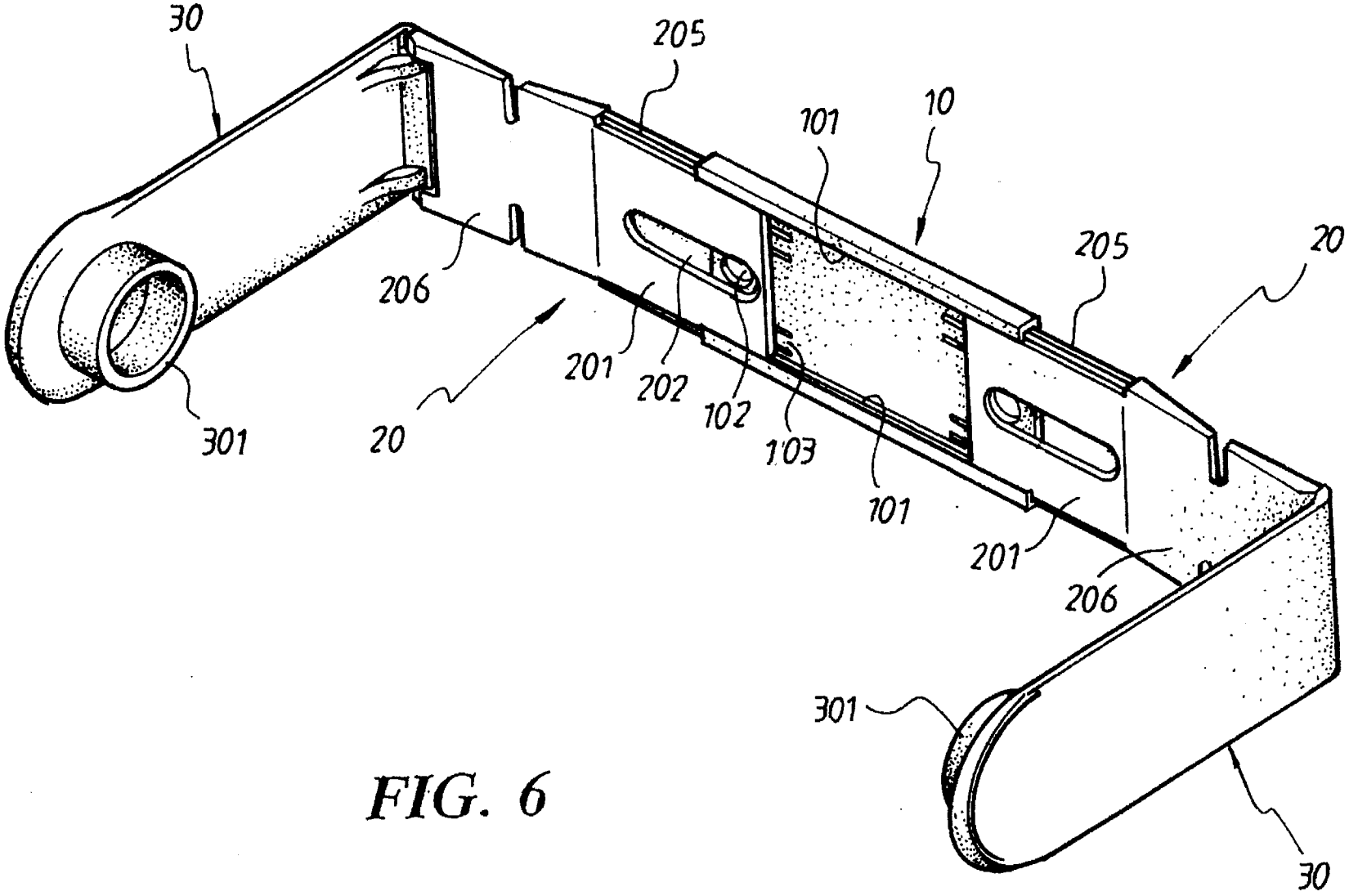
FIG. 6 is a perpective view of the paper towel holder of the present invention for use with paper towels of a large size.
Figure 7:
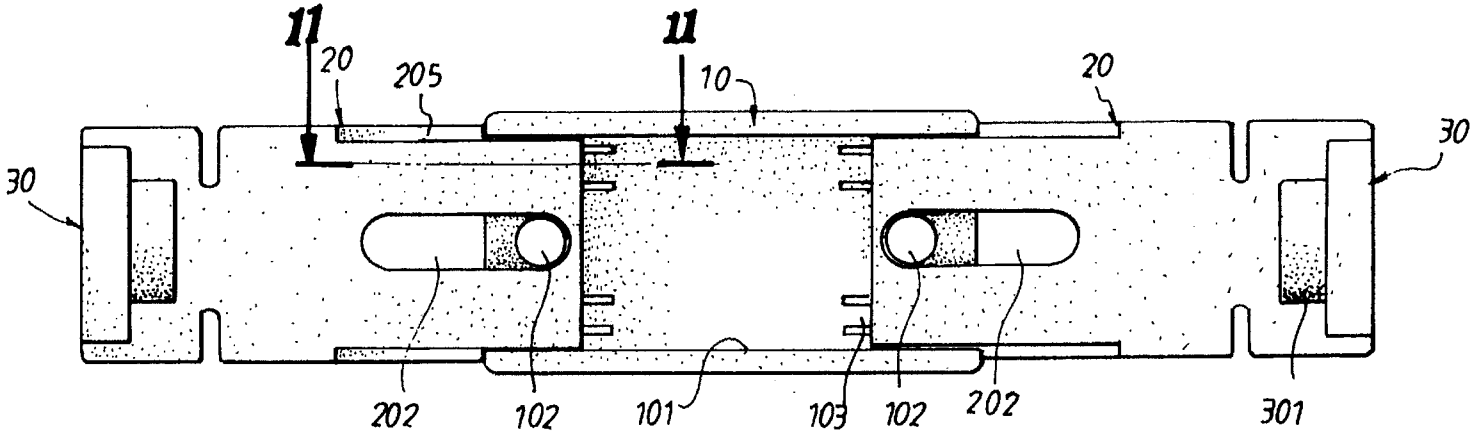
FIG. 7 is a front elevation view of the paper towel holder of FIG. 6.
Figure 8:
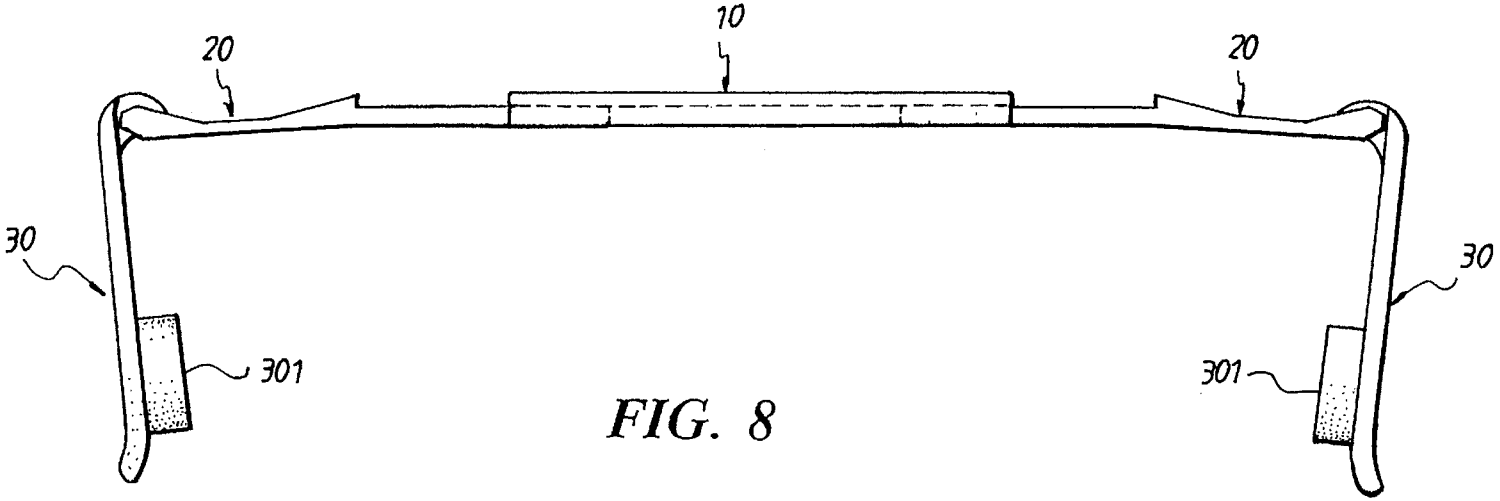
FIG. 8 is a top view of the paper towel holder of FIG. 6.

FIGS. 6, 7 and 8 are perspective, front elevation and top views, respectively, of the holder 1 of the present invention. It can be seen that the pull-out plates 20 are moved apart away from the fixed plate 10 such that the inner plates 201 are moved into a second retained position so as to enlarge the spacing between the fitting tubes 301 on the supporting arm plates for accommodating paper towels of the large size.

Figure 9:
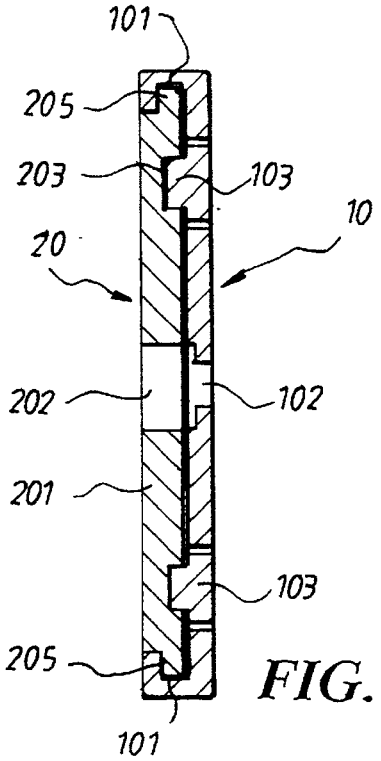
FIG. 9 is a cross section view of the paper towel holder of FIG. 3.
Figure 11:
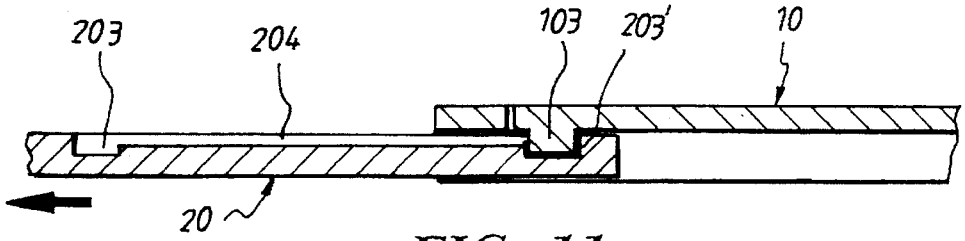
FIG. 11 is a cross section view of the paper towel holder of FIG. 7.
Figure 10:
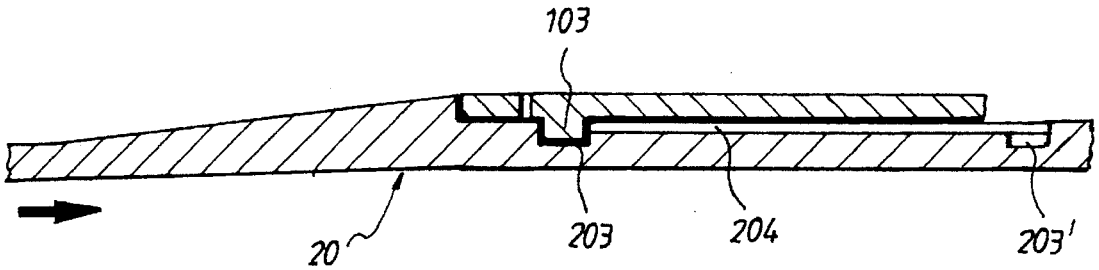
FIG. 10 is a cross section view of the paper towel holder of FIG. 4.

From the cross section view of FIG. 11 taken along line 11—11 in FIG. 7, it can be seen that when the pull-out plates 20 are moved in the direction away from the fixed plate 10 into the second retained position, the resilient buttons 103 can be moved from the retaining holes 203 as shown in FIG. 10 into the holes 203 on the other end of the slots 204 and positioned as shown in FIGS. 7, 8 and 9 for accommodating paper towels of the large size.

From the foregoing, it can be seen that the paper towel holder 1 of the present invention is characterized in that the pull-out plates 20, when being pulled out or pushed in, can be retained in a certain position by means of the retaining buttons 103, 103 corresponding to the slots 20 on the pull-out plates 20 and the retaining holes 203, 203 on both ends of the slots such that the spacing between the supporting arm plates 30 and the pull-out plates 20 can be changed for use with commercially available paper towels of different specifications and that the supporting arm plates 30 and the pull-out plates 20 are pivotally connected such that they can be folded for space-saving storage.

While the present invention has been described in connection with a preferred embodiment, related modifications and alterations can be made by those skilled in the art with reference to the above description without departing from the scope thereof. Therefore, it is intended that the spirit and scope of the present invention are only defined by the appended Claims.

I claim:

1. A width changeable paper towel holder comprising a fixed plate, a pair of pull-out plates and a pair of supporting arm plates characterized in that:

the fixed plate is an elongated plate body, the upper and lower sides thereof being each provided with an opposed grooved rail, the elongated plate body being provided on the four corners with four resilient buttons;

the pull-out plates include an inner plate and an outer plate, the inner plate being provided on the upper and lower edges with flanges and on the back side with recessed slots, said recessed slots are provided on both ends with recessed retaining holes and the outer plate being provided on the side ends with a pivotal connecting mechanism;

the supporting arm plates are each provided at one end with a pivotal portion for pivotal connection to the pivotal connecting mechanism of the outer plate, the inner side of the other end being provided with a fitting tube; wherein the pull-out plates can be each inserted from the sides of the fixed plate by fitting the flanges of the inner plates into the grooved rails on the fixed plate so as to move between a first retained position where the four resilient buttons of the fixed plate are retained in the retaining holes close to the outer side in the upper and lower slots on the inner plates and a second retained position where the four resilient buttons of the fixed plate are retained in the retaining holes close to the inner side in the upper and lower slots on the inner plates.

2. The width changeable paper towel holder according to claim 1 wherein said flanges of the inner plates have step shaped end faces such that the inner plates can be inserted into the fixed plate by fitting the flanges into the grooved rails of the fixed plate.

* * * * *